US005586648A

United States Patent [19]

Focke et al.

[11] Patent Number: 5,586,648

[45] Date of Patent: Dec. 24, 1996

[54] HINGE-LID CIGARETTE PACK MADE FROM A ONE-PIECE BLANK

[75] Inventors: Heinz Focke, Verden; Henry Buse, Visselhövede, both of Germany

[73] Assignee: Focke & Co. (GmbH & Co.), Verden, Germany

[21] Appl. No.: 493,279

[22] Filed: Jun. 21, 1995

[30] Foreign Application Priority Data

Jun. 22, 1994 [DE] Germany ..... 44 21 445.6

[51] Int. Cl.[6] ..... B65D 5/66

[52] U.S. Cl. ..... 206/264; 206/268; 206/273; 229/160.1

[58] Field of Search ..... 206/264, 265, 206/268, 273; 229/160.1, 146

[56] References Cited

U.S. PATENT DOCUMENTS

| | | | |
|---|---|---|---|
| Re. 142 | 9/1849 | Battin . | |
| 1,980,193 | 11/1934 | Finegan | 83/75 |
| 2,803,394 | 8/1957 | Ringler | 206/268 X |
| 2,824,684 | 2/1958 | Ahlers | 206/268 X |
| 2,861,733 | 11/1958 | Metzger | 206/264 X |
| 2,922,564 | 1/1960 | Rosen | 206/268 X |
| 3,387,795 | 6/1968 | Bidwell | 241/34 |
| 3,393,634 | 7/1968 | Blackford | 100/39 |
| 3,406,624 | 10/1968 | Kutchera et al. | 100/176 |
| 4,050,980 | 9/1977 | Schmidt et al. | 162/24 |
| 4,235,382 | 11/1980 | Smith | 241/28 |
| 4,723,718 | 2/1988 | LaPointe | 241/235 |
| 4,729,508 | 3/1988 | Erdmann et al. | 206/268 X |
| 4,903,845 | 2/1990 | Artiano | 209/671 |
| 5,203,495 | 4/1993 | Jörgensen-Beck et al. | 229/225 |
| 5,325,963 | 7/1994 | Focke et al. | 206/268 |
| 5,465,836 | 11/1995 | Focke | 206/264 |

FOREIGN PATENT DOCUMENTS

| | | |
|---|---|---|
| 1174092 | 9/1984 | Canada . |
| 530651 | 10/1993 | European Pat. Off. . |
| 628497 | 12/1994 | European Pat. Off. . |
| 2113572 | 6/1972 | France . |
| 2677960 | 12/1992 | France . |
| 2333727.1 | 2/1975 | Germany . |
| 9103760 | 8/1991 | Germany . |
| 4142022 | 6/1993 | Germany . |
| 301802 | 10/1994 | Germany . |
| 1037946A | 8/1983 | U.S.S.R. . |
| 261753 | 12/1927 | United Kingdom . |
| 406262 | 6/1932 | United Kingdom . |
| 1462915 | 1/1977 | United Kingdom . |
| WO9014278 | 11/1990 | WIPO . |
| WO91/03595 | 3/1991 | WIPO . |

OTHER PUBLICATIONS

Oldham, J. A., "A machine for destructuring wood chips by rolling," *Appita* 37(1): 65–69, Jul. 1983.

Lachenal, Monzie & de Choudens, "Chip Destructuring Improves Kraft Pulpin," *1984 Pulping Conference (TAPPI Proceedings)*: 12–16, Dec. 1984.

*Primary Examiner*—Jacob K. Ackun

*Attorney, Agent, or Firm*—Sughrue, Mion, Zinn, Macpeak & Seas

[57] ABSTRACT

Hinge-lid pack for cigarettes or the like with a box part (12), lid (13), and collar (38).

For the material-saving and simpler manufacture of hinge-lid packs, a collar is connected to a main blank (33) in one-piece via material webs (43, 44). The material webs connect the collar (38) to the lid inner tab (36) in the region of side webs (49, 50) of a collar front wall (39). The relative position is chosen such that the collar (38) assumes the appropriate position after being folded over.

5 Claims, 3 Drawing Sheets

HINGE-LID CIGARETTE PACK MADE FROM A ONE-PIECE BLANK

BACKGROUND OF THE INVENTION

The invention relates to a hinge-lid pack for cigarettes or the like made from a (originally) one-piece blank for forming a box part, a lid connected pivotably thereto, and a collar which is anchored in the box part and, in the region of a collar front wall, separably connected via residual connections to a lid inner tab, which is attached to the inner side of a lid front wall. The invention further relates to a blank for producing hinge-lid packs.

Hinge-lid packs are an internationally conventional pack type for cigarettes. They are made from thin cardboard. A main blank serves for forming a (lower) box part, and a lid which is connected pivotably thereto. Furthermore, a collar belongs to the hinge-lid pack, having a collar front wall and collar side tabs. The collar, which was mainly made from a separate blank heretofore, is anchored in the box part and projects therefrom with an upper sub-region.

Recently, hinge-lid packs have been proposed which are made from an originally one-piece overall blank which includes the collar. The latter is connected to the main blank by narrow residual connections of the packaging material. The residual connections are positioned and dimensioned so as to be severed when opening the pack for the first time.

SUMMARY OF THE INVENTION

The invention relates to hinge-lid packs which are made from an originally one-piece overall blank. The invention is based on the object to design and position the collar and the residual connections in such a manner that, one the one hand, a perfect handling of the pack, especially when opening the pack for the first time and, on the other hand, a problem-free automatic processing of the overall blank at a very high performance is ensured.

To attain this object, the hinge-lid pack according to the invention is characterized by the following features:

a) the residual connections between collar and overall blank are positioned at a distance from an upper edge as well as a lower edge of the lid front wall, b) the residual connections are located in the region of a transversely directed punch or separation line (which extends parallel to the edge of the front wall), or of a leg thereof, for delimiting the lid inner tab from the collar front wall.

The positioning of the residual connections to be severed permits a material-saving positioning of the collar as a part of the overall blank. The residual connections are arranged at both sides of a conventional depression which is formed in the region of the collar front wall. A separation or punch line extends in the region of the blank in such a manner that lateral regions of the collar front wall are delimited by a transversely or horizontally extending leg of the punch line. The lid inner tab is designed with a corresponding contour and enters into the depression of the collar front wall with a tongue before the folding.

Collar side tabs are provided with a recess which is a continuation of the punch or separation line and which faces the front side in the finished hinge-lid pack and permits an easier extraction of the cigarettes when using the pack for the first time.

BRIEF DESCRIPTION OF THE DRAWINGS

Further features of the invention relate to the configuration of the blank, especially the configuration of the collar and the lid. An exemplary embodiment of the invention is explained in more detail hereinbelow with reference to the drawings, in which.

DESCRIPTION OF PREFERRED EMBODIMENTS

Figure 1:
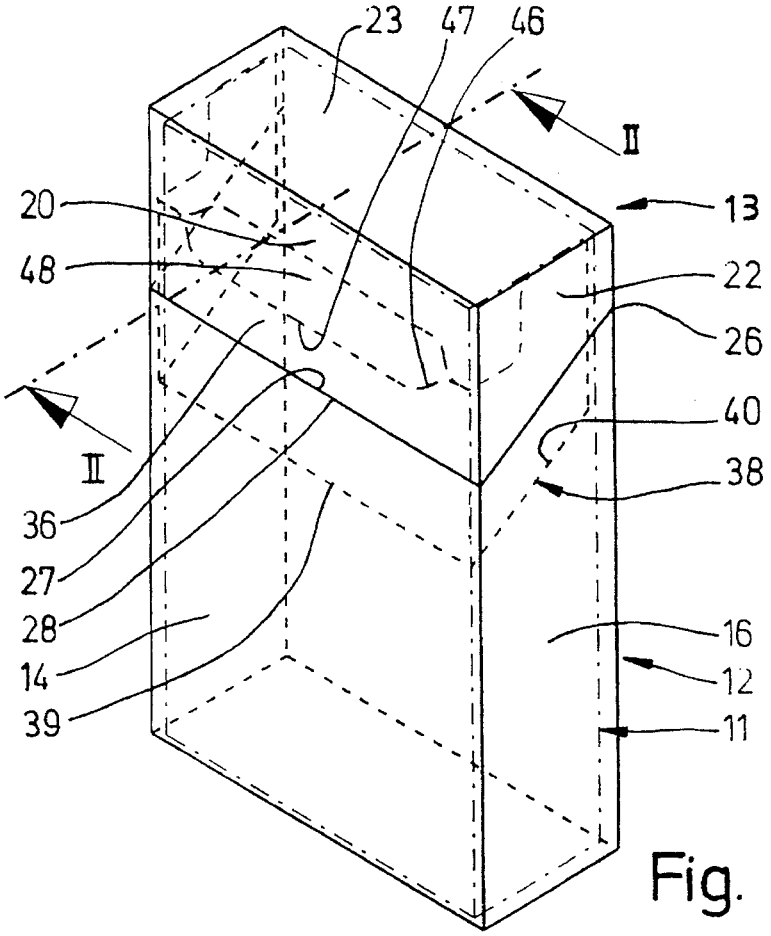
FIG. 1 shows a perspective representation of a closed hinge-lid pack.
Figure 2:
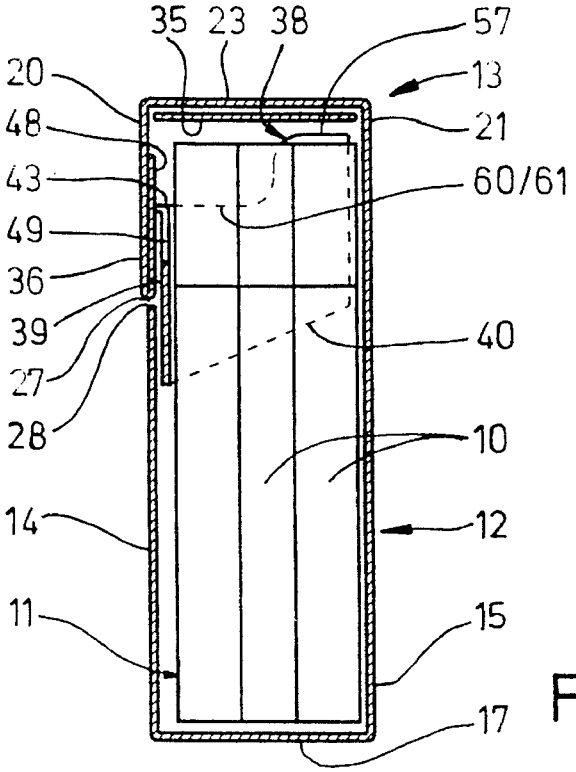
FIG. 2 shows a vertical section through the hinge-lid pack according to FIG. 1, along section plane II—II.
Figure 3:
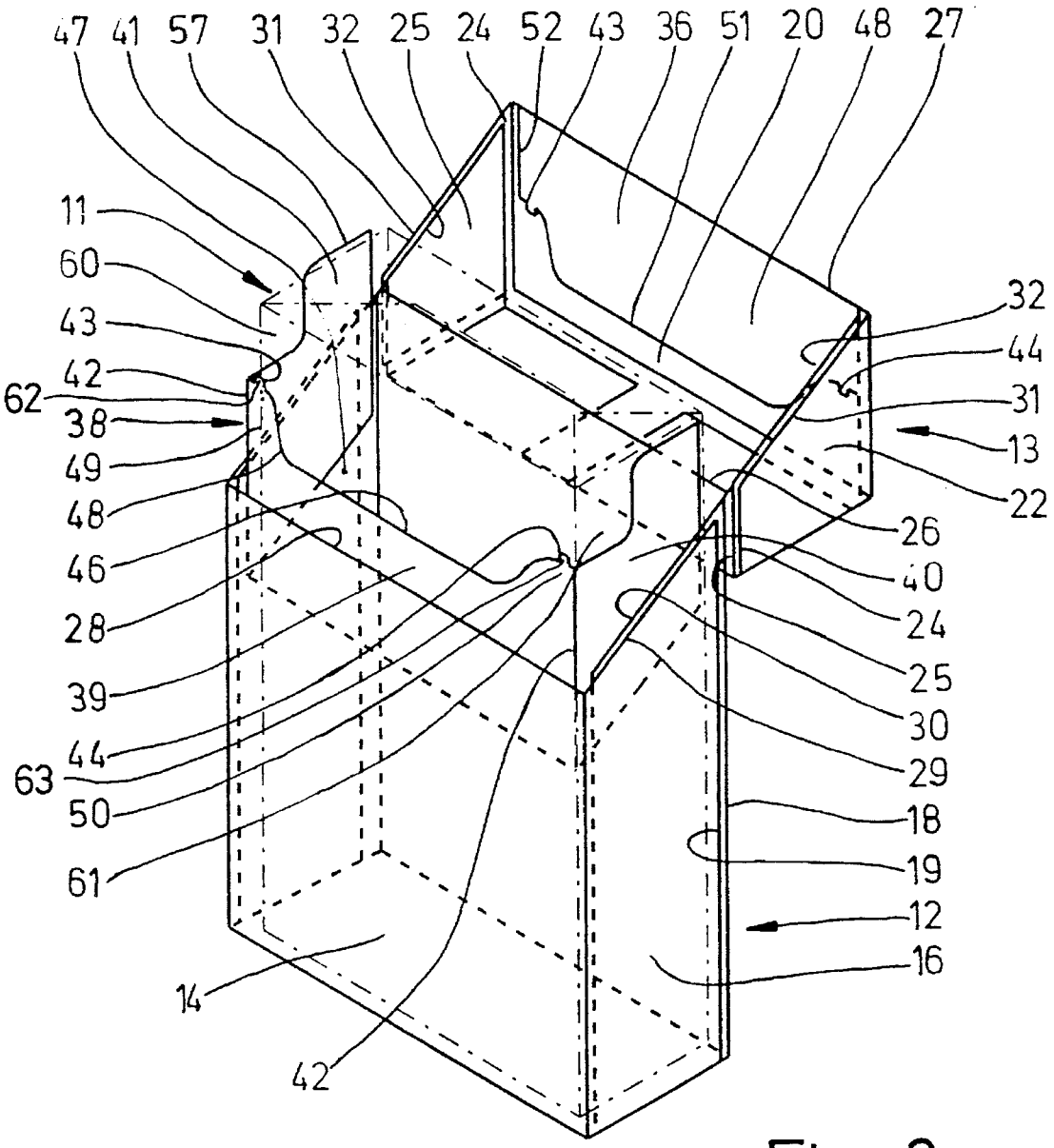
FIG. 3 shows the hinge-lid pack according to FIG. 1 in the open position.

The exemplary embodiments in the drawings relate to a hinge-lid pack for cigarettes 10. A cigarette group is wrapped in an inner blank of paper or tin-foil and thus forms, as cigarette block 11, the contents of the pack.

The hinge-lid pack shown comprises, as do conventional packs of this type, a box part 12 and a lid 13. The box part 12 comprises a box front wall 14, a box rear wall 15, narrow box side walls 16, and a base wall 17. The box side walls 16 are formed from mutually overlapping box side tabs 18 and 19 which are connected to one another by adhesive bonding. Analogously thereto, the lid 13 comprises a lid front wall 20, a lid rear wall 21, lid side walls 22, and an upper end wall 23. The lid side walls 22 are formed from mutually overlapping lid side tabs 24 and 25 which are adhesively bonded to one another. Box part 12 and lid 13 are connected pivotably to one another, in the region of box rear wall 15 and lid rear wall 21, along an articulation line 26.

In the closed position, a transversely directed abutment joint is formed between box part 12 and lid 13 in the region of the front wall, said abutment joint being defined, on the side of the lid 13, by a lower lid edge 27 of the lid front wall 20 and, in the region of the box front wall 14, by an upper edge 28. In the region of the side walls, an obliquely upwardly directed abutment edge is created by oblique edges 29 and 30 of the box side tabs 18, 19, on the one hand, and corresponding oblique edges 31, 32 of the lid side tabs 24, 25, on the other.

Box part 12 and lid 13 form a main blank 33 for the hinge-lid pack. The main blank 33 also comprises base corner tabs 34 and lid corner tabs 35. A lid inner tab 36 adjoins the free side of the lid front wall 20. In the finished hinge-lid pack, the lid inner tab 36 is folded over against the inner side of the lid front wall 20 and connected thereto. Lid front wall 20 and lid inner tab 36 thus form the lid edge 27.

A further constituent part of the hinge-lid pack is a collar 38. The latter comprises a collar front wall 39 and collar side tabs 40 and 41. In the finished hinge-lid pack, the collar 38 is seated with a lower region in the box part 12 and is fixed here on the inner side of the box front wall 14 and/or the box side walls 16 by adhesive bonding. That region of the collar 38 which projects from the box part 12 is surrounded by the lid 13 when the pack is in the closed position. Collar front wall 39, on the one hand, and collar side tabs 40, 41, on the other hand, are separated from one another by folding edges or folding lines 42. The latter are defined by perforations.

Figure 4:
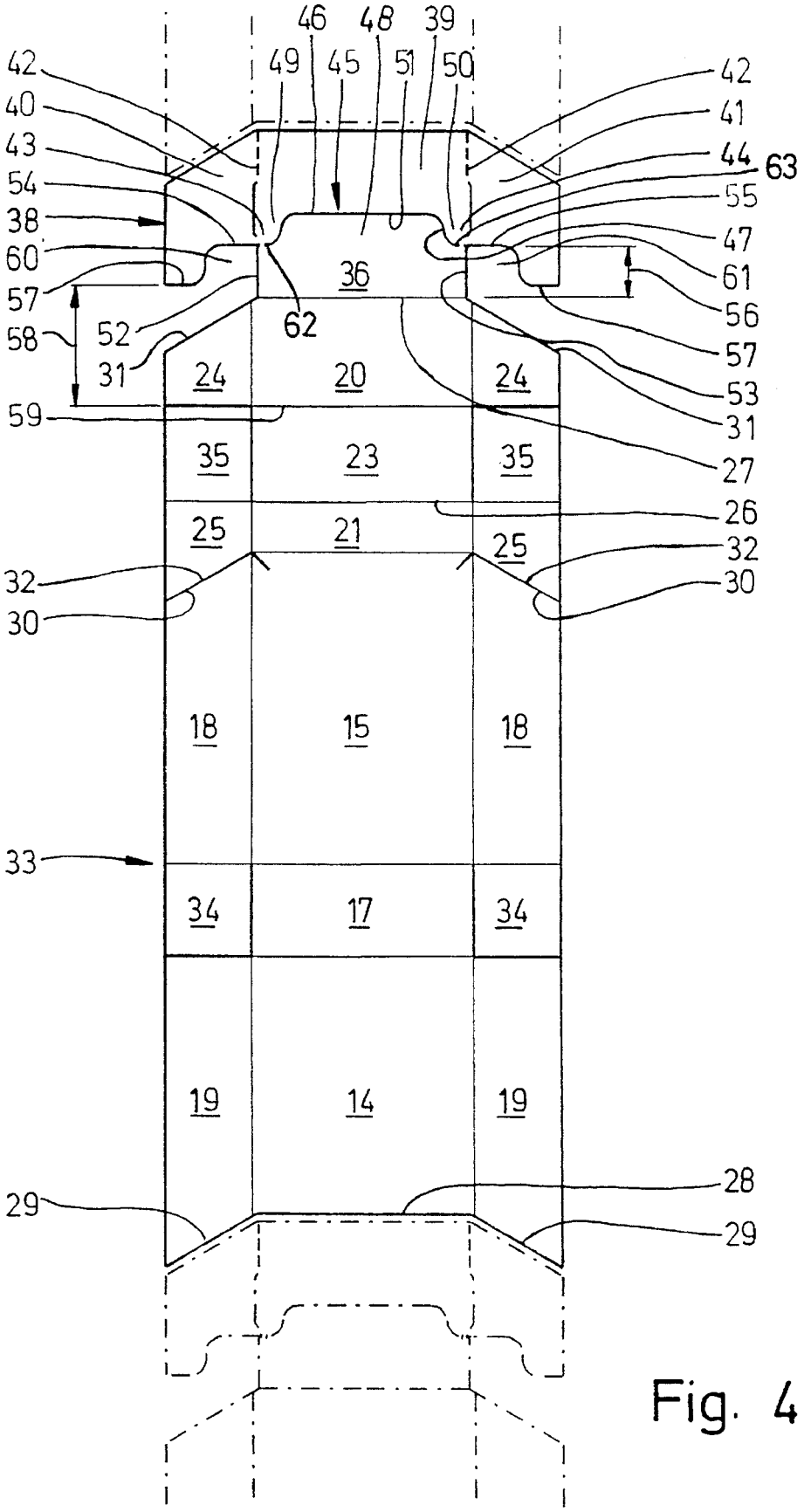
FIG. 4 shows a spread-out blank for a hinge-lid pack according to FIG. 1 to FIG. 3.

The collar 38 forms a one-piece unit with the main blank 33 of the hinge-lid pack, namely an overall blank (FIG. 4). For this purpose, the collar 38 is connected to the main blank 33 via material webs 43 and 44. The material webs are thin residual connections of the packaging material, having a width of approximately 1 mm. The material webs 43, 44 are formed by an interrupted punch line 45 between main blank 33 and collar 38.

The collar 38 is thus connected to the lid inner tab 36 by the separable material webs 43, 44. The position of the material webs 43, 44 is particularly important for the correct positioning of the collar 38 in the finished hinge-lid pack. For this purpose, the punch line 45 forms, at its ends, horizontally or transversely directed edge legs 62, 63. The two material webs 43, 44 are located in the region of the edge legs 62, 63, and thus in the region of adjacent edges of collar 38 and lid inner tab 36 which extend transversely relative to the longitudinal extension of the blank.

In the production of the hinge-lid pack, first of all the collar 38 of the otherwise unfolded blank according to FIG. 4 is folded over about 180° until it abuts the main blank 33. The collar 38 is folded over in the region of the material webs 43, 44 which rest in a common folding axis for the collar 38. In this manner, the material webs 43, 44 form articulated connections between collar 38 and main blank 33.

In the further folding of the blank, due to the predefined relative position, the collar automatically assumes the appropriate position in which a lower sub-region is anchored in the box part 12, and an upper sub-region projects therefrom, so that an upper collar edge 46 is exposed.

The collar front wall 39 — as conventional — is designed in a special manner, such that, in the central region, a depression 47 is formed which is delimited by arcuate contours. This depression 47 serves for the easier extraction of the cigarettes. The depression 47 is delimited by the collar edge 46. At the sides, namely adjacent to upright front pack edges, the collar forms respective lateral webs 49, 50. The lateral webs 49, 50 delimit the depression 47.

The lid inner tab 36 has an edge 51 facing the collar front wall 39, the contour of the former corresponding to the contour of the collar front wall 39, so that the blank parts positively fit into each other. The lid inner tab 36 thus forms a tongue 48 which projects into the depression 47.

The material webs 43, 44 are arranged in the region of the lateral webs 49, 50, immediately adjacent to lateral edges 52, 53 of the lid inner tab 36. Upright corner edges of the collar 38 which are defined by folding lines 42 extend in continuation of the lid inner tab 36. In this region, the punch line 45 extends transversely to the longitudinal extension of the blank and thus parallel to transverse folding lines, e.g. parallel to the lid edge 27.

The collar side tabs 40, 41 also project from the box part 12. It must be ensured that a free upper edge 57 of the collar side tabs 40, 41 does not abut the end wall 23 when the lid is in the closed position. On the contrary, a distance of approximately 1 mm is required. This results in a geometrical interrelation to the effect that the length of the lateral edges 52, 53 of the lid inner tab 36, and thus the dimension 56, should not be more than half the distance between the upper edge 57 and the end wall. Applied to the blank according to FIG. 4 this is dimension 58. This results in the requirement $56 \leqq \frac{1}{2} \cdot 58$. The dimension 58 is defined by the folding line 59 here, which is formed between lid front wall 20 and end wall 23.

The collar side tabs 40, 41 are designed with special contours in the present case, namely such that recesses 60, 61 are formed which face the front side of the hinge-lid pack. These recesses cause the side webs 49, 50 of the collar 38 to have less height. This also results in a simplified extraction of cigarettes, especially in the corner regions. The recesses 60, 61 are delimited by the punch line 45, which forms transversely directed legs 54, 55 as straight continuations of the punch line 45 in the region of the material webs 43, 44. The legs 54, 55 and the material webs 43, 44 are situated on a common transverse line.

What is claimed is:

1. In a hinge-lid pack for cigarettes (10) that is made from a one-piece overall blank of material from which are formed a pack part (12), a lid (13) connected pivotably to said pack part (12), and a collar (38) which is anchored in the pack part (12) and which has a portion that projects outwardly from the pack part (12), the improvement wherein:

a) tile lid has an inner tab and the lid (13) is connected to the collar (38) via material webs (43,44) in a region of the lid inner tab (36) until tile hinge-lid pack is opened for the first time;

b) the lid inner tab (36) is connected by tile material webs (43,44) to an upper free edge of a collar front wall (39), the edge being formed by a punch line (45);

c) the punch line (45) forms transversely directed edge legs (62, 63) at lateral edge regions of the collar front wall (39), said edge legs (62, 63) defining lateral webs (49, 50) of the collar front wall (39);

d) the material webs (43, 44) are located in the edge legs (62, 63) and immediately adjacent to upright folding lines (42) between the collar front wall (39) and collar side tabs (40, 41); and e) the collar side tabs (40, 41) are each provided with a recess (60, 61) which faces the lateral webs (49, 50), and which is defined by the punch line (45), first as an extension of the edge legs (62, 63) in a region adjacent to the collar side tabs (40, 41), and second as an upper edge (57), which extends parallel to the edge legs, in a region of the collar side tabs (40, 41) which is spaced apart from the lateral webs (49, 50).

2. The hinge-lid pack as claimed in claim 1, wherein the lid has a lid from wall (20), and an upper end wall (23) which is spaced from the punch line (45) by a distance in a region of the material webs (43, 44), and wherein the collar side tabs (40, 41) are dimensioned, such that the upper edge (57) extends at a small distance from an inner side of the end wall (23) of the lid (13) when the hinge-lid pack is closed.

3. The hinge-lid pack as claimed in claim 2, wherein the edge legs (62, 63) are spaced from a lower lid edge (27) of tile lid front wall (20) by a distance that is smaller or equal to half the distance between the upper edge (57) of tile collar side tabs (40, 41) and a folding line (59) that extends between the lid front wall (20) and the lid end wall (23).

4. In a blank of material for hinge-lid cigarette packs, and having regions for forming a pack part (12), a lid (13) and a collar (38), wherein a lid rear wall (21) is connected to a pack rear wall (15), and wherein a lid end wall (23), a lid front wall (20) and a lid inner tab (36) successively adjoin the lid rear wall (21), the improvement wherein:

a) the collar (38) adjoins the lid inner tab (36) at a collar front wall (39) and collar side tabs (40, 41);

b) the collar (38) is separated frown the lid inner tab (36) by a mainly transversely directed punch line (45) in a region of the collar front wall (39);

c) the punch line (45) forms a depression (47) in the collar front wall (39) and ends with transversely directed edge legs (62, 63) at edge region of the lid inner tab (36), thereby forming lateral webs (49, 50) in a region of the collar front wall (39);

d) the collar (38) is connected to the lid inner tab (36) in a region of the edge legs (62, 63) by only one material web (43, 44) each; and e) the collar side tabs (40, 41) are each provided with a recess (60, 61) which faces the lateral webs (49, 50), and which is defined by the punch line (45), first as an extension of the edge legs (62, 63) in a region adjacent to the collar side tabs (40, 41), and second as an upper edge (57), which extends parallel to the edge legs, in a region of the collar side tabs (40, 41) which is spaced apart from the lateral webs (49, 50).

5. The blank as claimed in claim 4, wherein the distance between the material webs (43, 44) and a lower lid edge (27) of the lid front wall (20), which extend in the same plane, is at the most equal to half the distance between the upper edge (57) of the collar side tabs (40, 41) and a folding line (59) located between the lid front wall (20) and the lid end wall (23).

* * * * *